US012287150B2

(12) United States Patent
Wang et al.

(10) Patent No.: US 12,287,150 B2
(45) Date of Patent: Apr. 29, 2025

(54) COMBINED HEAT EXCHANGER

(71) Applicant: ZHEJIANG DUNAN ARTIFICIAL ENVIRONMENT CO., LTD., Shaoxing (CN)

(72) Inventors: Guanjun Wang, Shaoxing (CN); Xinyu Liang, Shaoxing (CN)

(73) Assignee: ZHEJIANG DUNAN ARTIFICIAL ENVIRONMENT CO., LTD., Shaoxing (CN)

( * ) Notice: Subject to any disclaimer, the term of this patent is extended or adjusted under 35 U.S.C. 154(b) by 208 days.

(21) Appl. No.: 18/114,996

(22) Filed: Feb. 28, 2023

(65) Prior Publication Data

US 2023/0204294 A1 Jun. 29, 2023

Related U.S. Application Data

(63) Continuation of application No. PCT/CN2021/101555, filed on Jun. 22, 2021.

(30) Foreign Application Priority Data

Sep. 1, 2020 (CN) ..... 202021878547.9

(51) Int. Cl.
*F28D 1/04* (2006.01)
*F25B 39/00* (2006.01)

(52) U.S. Cl.
CPC ..... *F28D 1/0408* (2013.01); *F25B 39/00* (2013.01)

(58) Field of Classification Search
CPC .. F28D 1/05391; F28D 1/0408; F28D 1/0443; F28D 2021/0068; F28D 1/05308;
(Continued)

(56) References Cited

U.S. PATENT DOCUMENTS 11,415,371 B2 * 8/2022 Matsumoto ..... F28D 1/0408
2017/0059252 A1 * 3/2017 Zhou ..... F28D 1/05366

FOREIGN PATENT DOCUMENTS

CN 103925745 A 7/2014
CN 105258532 A 1/2016
(Continued)

OTHER PUBLICATIONS

Pdf is original document of foreign reference EP 3276289 A1 (Year: 2018).*

(Continued)

*Primary Examiner* — Henry T Crenshaw
*Assistant Examiner* — Kamran Tavakoldavani

(57) ABSTRACT

A combined heat exchanger is provided. The combined heat exchanger includes at least two heat exchanger cores, a first communicating member and a second communicating member. Each of the at least two heat exchanger cores includes at least a first collecting pipe, a second collecting pipe and multiple flat pipes. The flat pipes are vertically disposed between the first collecting pipe and the second collecting pipe. Both ends of the first communicating member are in communication with the first collecting pipes of two adjacent heat exchanger cores, respectively; both ends of the second communicating member are in communication with the second collecting pipes of the two adjacent heat exchanger cores, respectively; and the two adjacent heat exchanger cores are disposed on different planes.

9 Claims, 1 Drawing Sheet

(58) Field of Classification Search
CPC ..... F24F 13/30; F28F 9/0243; F28F 9/0248; F28F 1/02; F28F 21/08; F28F 9/26; F25B 39/00; F25B 39/02
See application file for complete search history.

(56) References Cited

FOREIGN PATENT DOCUMENTS

| | | | | |
|---|---|---|---|---|
| CN | 107514841 | A | 12/2017 | |
| CN | 206905358 | U | 1/2018 | |
| CN | 207113298 | U | 3/2018 | |
| EP | 3276289 | A1 * | 1/2018 | ..... F24F 5/00 |
| JP | 2004286246 | A | 10/2004 | |
| JP | 2005133966 | A | 5/2005 | |
| JP | 2005155966 | A | 6/2005 | |
| JP | 2013076521 | A | 4/2013 | |
| JP | 2016534314 | A | 11/2016 | |
| WO | WO2013161038 | A1 | 10/2013 | |
| WO | WO2017097133 | A1 | 6/2017 | |

OTHER PUBLICATIONS

International Search Report of PCT/CN2021/101555.
First Notice of Reasons for Refusal of JP2023503424-20240417.
Second Notice of Reasons for Refusal of JP2023503424-20240821.

* cited by examiner

COMBINED HEAT EXCHANGER

CROSS-REFERENCE TO RELATED APPLICATION

This application is a continuation of international patent application No. PCT/CN2021/101555, filed on Jun. 22, 2021, which itself claims all benefits accruing from China Patent Application No. 202021878547.9, filed on Sep. 1, 2020, and titled "COMBINED HEAT EXCHANGER", in the China National Intellectual Property Administration, the contents of which are hereby incorporated by reference.

TECHNICAL FIELD

The present disclosure relates to the field of refrigerating system, in particular to a combined heat exchanger.

BACKGROUND

Main components of the air conditioning system include a compressor, a condenser, a throttling device and a heat exchanger. The heat exchanger plays the role of heat exchange with the outside environment. Conventionally, collecting pipes of the heat exchanger are connected with vertical flat pipes, and an approximately square-shaped heat exchanger structure is formed by bending the collecting pipes.

However, sometimes improper bending of the collecting pipe may lead to deformation of the flat pipe, thereby reducing the heat transfer performance of the heat exchanger. In addition, a bending process of the collecting pipe has many requirements, and a material of the bending section has plastic deformation, which can easily cause surface damage, leading to material corrosion and resulting in leakage.

SUMMARY

A combined heat exchanger, which has a good heat transfer performance, a simple structure and is convenient to assemble and disassemble can solve the technical problem above.

In order to solve the technical problems above, a technical solution is provided herein in the present disclosure.

A combined heat exchanger includes at least two heat exchanger cores, a first communicating member and a second communicating member. Each of the at least two heat exchanger cores includes at least a first collecting pipe, a second collecting pipe and a plurality of flat pipes. The plurality of flat pipes are vertically disposed between the first collecting pipe and the second collecting pipe. Both ends of the first communicating member are in communication with the first collecting pipes of two adjacent heat exchanger cores, respectively; both ends of the second communicating member are in communication with the second collecting pipes of the two adjacent heat exchanger cores, respectively; and the two adjacent heat exchanger cores are disposed on different planes.

In the present disclosure, since the first communicating member are in communication with the two adjacent first collecting pipes and the second communicating member are in communication with the two adjacent second collecting pipes, two adjacent heat exchanger cores are in communication to form a combined heat exchanger without bending the first collecting pipe or the second collecting pipe. Conditions such as deformation and surface loss caused by improper bending of the first collecting pipe or the second collecting pipe can be avoided, so that the combined heat exchanger can have improved heat transfer performance and be convenient to assemble or disassemble.

In some embodiments, the first communicating member includes two first linear pipes and a first bending pipe disposed between the two first linear pipes, and one end of the first linear pipe is in communication with the first collecting pipe and connected to the first collecting pipe by welding.

In this way, by assembling and disassembling of the first communicating member, it is convenient for free assembling and disposing the heat exchanger cores, and problems of leakage caused by improper bending of the first collecting pipe will not be caused.

In some embodiments, both ends of the first bending pipe are provided with flared sections, respectively. The two first linear pipes extend into the corresponding flared section, respectively, and are in communication with the first bending pipe.

In this way, the first linear pipes can extend into fixed positions in the first bending pipe, so as to facilitate communication and connection between the first linear pipe and the first bending pipe.

In some embodiments, the second communicating member includes two second linear pipes and a second bending pipe disposed between the two second linear pipes, and one end of the second linear pipe is in communication with the second collecting pipe and connected to the second collecting pipe by welding.

In this way, by assembling and disassembling of the second communicating member, it is convenient for free assembling and disposing the heat exchanger cores, and problems of leakage caused by improper bending of the second collecting pipe will not be caused.

In some embodiments, a diameter of the second bending pipe is greater than a diameter of the first bending pipe.

Therefore, on condition that the combined heat exchanger core is used as an evaporator, when a gas-liquid two-phase fluid media flows into the first bending pipe, a volume of the fluid media may increase after transferring into a gas phase, so that the fluid media may enter into the second bending pipe. At this time, since the diameter of the second bending pipe is greater than the diameter of the first bending pipe, the second bending pipe may have enough space for the gas phase fluid media to enter.

In some embodiments, the combined heat exchanger further includes a liquid separator. The liquid separator is located in the first collecting pipe. Both ends of the first communicating member are in communication with the liquid separators of two adjacent first collecting pipes, respectively.

In this way, since the liquid separator is located in the first collecting pipe, and in communication with the first communicating member, it is convenient for disassembling and replacing of the liquid separator.

In some embodiments, the combined heat exchanger further includes a connecting member. The connecting member is fixed to sideboards of the two adjacent heat exchanger cores, and the connecting member is made of metal.

In this way, the connecting member can be configured for improving fixing connection and shielding.

In some embodiments, combined heat exchanger further includes an inlet pipe and an outlet pipe. The inlet pipe is in communication with the first collecting pipe, and the outlet pipe is in communication with the second collecting pipe.

In this way, the inlet pipe and the outlet pipe can facilitate communication of the fluid media. When the combined heat exchanger is used as the evaporator, the gas-fluid two-phase fluid medium enters into the first collecting pipe via the inlet pipe, transfers into gas phase by evaporating, and flows into the outlet pipe via the second collecting pipe.

In some embodiments, the inlet pipe and the outlet pipe are disposed on a same heat exchanger core of the at least two heat exchanger cores. In some embodiments, the inlet pipe and the outlet pipe are disposed on different heat exchanger cores of the at least two heat exchanger cores.

In this way, the fluid media can flow into the heat exchanger core via the inlet pipe for heat exchange, and a transformed fluid medium can flow towards the outlet pipe.

The present disclosure further provides an air conditioning system, which includes the combined heat exchanger disclosed above.

Compared with conventional art, in the present disclosure, since the first communicating member are in communication with the two adjacent first collecting pipes and the second communicating member are in communication with the two adjacent second collecting pipes, two adjacent heat exchanger cores are in communication to form a combined heat exchanger without bending the first collecting pipe or the second collecting pipe. Conditions such as deformation and surface loss caused by improper bending of the first collecting pipe or the second collecting pipe can be avoided, so that the combined heat exchanger can have improved heat transfer performance and be convenient to assemble or disassemble.

In the figures, 100 represents a combined heat exchanger; 10 represents a heat exchanger core; 11 represents a first collecting pipe; 12 represents a second collecting pipe; 13 represents a flat pipe; 14 represents a sideboard; 20 represents a first communicating member; 21 represents a first bending pipe; 22 represents a first linear pipe; 23 represents a flared section; 30 represents a second communicating member; 31 represents a second bending pipe; 32 represents a second linear pipe; 40 represents a connecting member; 50 represents an inlet pipe; and 60 represents an outlet pipe.

DETAILED DESCRIPTION

The embodiments of the present disclosure will be described clearly and completely below in conjunction with the accompanying drawings in the embodiments of the present disclosure. Obviously, the described embodiments are only a part of the embodiments of the present disclosure, but not all of them. Based on the embodiments in the present disclosure, all other embodiments obtained by the skilled in the art without making creative labor fall within the scope of protection of the present disclosure.

It is important to note that when a component is said to be "disposed" on another component, it may be disposed directly on another component or there may be a centered component. When a component is considered to be "mounted" on another component, it may be mounted directly on the other component or there may be both centered components. When a component is considered to be "fixed" to another component, it may be fixed directly to the other component or there may be a centered component as well.

Unless otherwise defined, all technical and scientific terms used herein have the same meaning as commonly understood by those skilled in the art belonging to the present disclosure. The terms used herein in the specification of the present disclosure are for the purpose of describing specific embodiments only and are not intended to limit the present disclosure. The term "or/and" as used herein includes any and all combinations of one or more of the related listed items.

Figure 1:
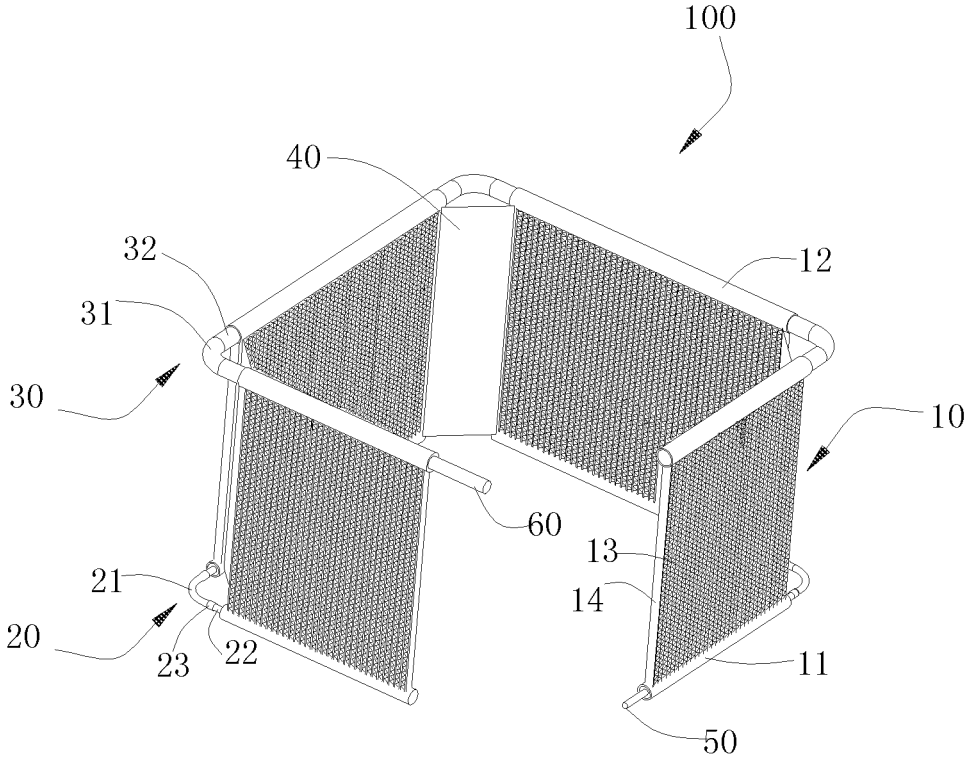
FIG. 1 is a structural schematic diagram of a combined heat exchanger in the present disclosure.

Referring to FIG. 1, the present disclosure provides a combined heat exchanger 100. The combined heat exchanger 100 can be used in an air conditioning system, and configured for heat exchange with the outside. In the present embodiment, the heat exchanger core 10 is a micro-channel heat exchanger core 10. In some embodiments, the heat exchanger core 10 can be a fin-type heat exchanger core 10 or other heat chanter cores 10.

FIG. 1 is a structural schematic diagram of a combined heat exchanger 100 in an embodiment of the present disclosure. The combined heat exchanger 100 includes at least two heat exchanger cores 10, a first communicating member 20 and a second communicating member 30. Each of the at least two heat exchanger cores 10 includes at least a first collecting pipe 11, and a second collecting pipe 12. Both ends of the first communicating member 20 are in communication with the first collecting pipes 11 of two adjacent heat exchanger cores 10, respectively. A fluid media can enter the combined heat exchanger 100 from the first collecting pipe 11, and flow between the two adjacent heat exchanger cores 10 through the first communicating member 20. Both ends of the second communicating member 30 are in communication with the second collecting pipes 12 of the two adjacent heat exchanger cores 10, respectively. The fluid media can flow between the two adjacent second collecting pipes 12 through the second communicating member 30.

It could be understood that since the first communicating member 20 are in communication with the two adjacent first collecting pipes 11 and the second communicating member 30 are in communication with the two adjacent second collecting pipes 12, two adjacent heat exchanger cores 10 are in communication to form a combined heat exchanger 100 without bending the first collecting pipe 11 or the second collecting pipe 12. Conditions such as deformation and surface loss caused by improper bending of the first collecting pipe 11 or the second collecting pipe 12 can be avoided, so that the combined heat exchanger 100 can have improved heat transfer performance and be convenient to assemble or disassemble.

Specifically, a diameter of the first collecting pipe 11 can be smaller than a diameter of the second collecting pipe 12. When a gas-liquid two-phase fluid media flows into the first collecting pipe 11, a volume of the fluid media may increase after transferring into a gas phase, so that the fluid media may enter into the second collecting pipe 12. At this time, since the diameter of the second collecting pipe 12 is greater than the diameter of the first collecting pipe 11, the second collecting pipe 12 may have enough space for the gas phase fluid media to enter.

Figure 2:
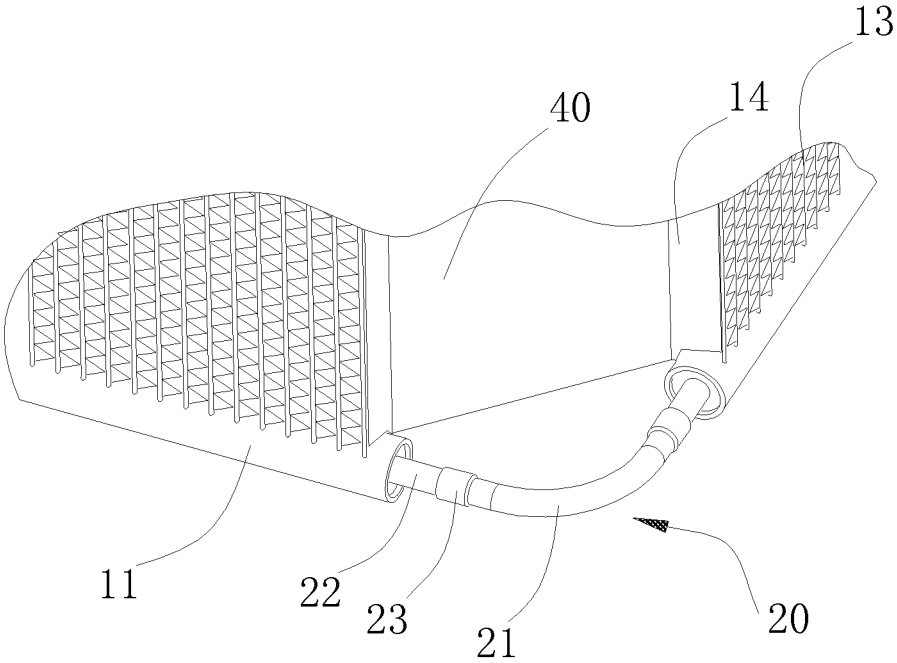
FIG. 2 is a partial enlarged figure showing connections between a first communicating member and adjacent two first collecting pipes of the combined heat exchanger in the present disclosure, respectively.

Furthermore, referring to FIG. 2, the first communicating member 20 can include two first linear pipes 22 and a first bending pipe 21 disposed between the two first linear pipes 22, and one end of the first linear pipe 22 can be in communication with the first collecting pipe 11 and connected to the first collecting pipe 11 by welding. By assembling and disassembling of the first communicating member 20, it can be convenient for free assembling and disposing the heat exchanger cores 10, and problems of leakage caused by improper bending of the first collecting pipe 11 will not be caused. In some embodiments, a diameter of the first bending pipe 21 can be smaller than those of the two first linear pipes 22, which can effectively avoid decreasing of flow rate of the fluid media at the first bending pipe 21 and influencing the heat exchange efficiency of the heat exchanger.

Referring to FIG. 1, the heat exchanger core 10 further includes a flat pipe 13, which is configured for discharging the condensate water.

Specifically, the flat pipes 13 can be vertically disposed. Both ends of the flat pipe 13 can be connected to the first collecting pipe 11 and the second collecting pipe 12, respectively. Due to action of gravity, when the water in the fluid media achieves a certain degree, the flat pipe 13 can discharge the condensate water, facilitating discharge of the condensate water. Each of the heat exchanger cores 10 can include a plurality of flat pipes 13. The plurality of flat pipes 13 can be disposed at intervals along an axis of the first collecting pipe 11 and an axis of the second collecting pipe 12.

In some embodiments, the combined heat exchanger 100 can further include a liquid separator (not shown). The liquid separator can be located in the first collecting pipe 11. Both ends of the first communicating member 20 can be in communication with the liquid separators in two adjacent first collecting pipes 11, respectively, which can facilitate disassembling and replacing of the liquid separator.

Specifically, both ends of the first bending pipe 21 are provided with flared sections 23, respectively, so that the two first linear pipes 22 can extend into the first bending pipe 21, and facilitate connection between the first linear pipe 22 and the first bending pipe 21. The two first linear pipes 22 can extend into the corresponding flared section 23, respectively, and be in communication with the first bending pipe 21.

Referring to FIG. 1, the second communicating member 30 can include two second linear pipes 32 and a second bending pipe 31 disposed between the two second linear pipes 32, and one end of the second linear pipe 32 can be in communication with the second collecting pipe 12 and connected to the second collecting pipe 12 by welding. By assembling and disassembling of the second communicating member 30, it is convenient for free assembling and disposing the heat exchanger cores 10, and problems of leakage caused by improper bending of the second collecting pipe 12 will not be caused. In some embodiments, a diameter of the second bending pipe 31 can be smaller than those of the two second linear pipes 32, which can effectively avoid decreasing of flow rate of the fluid media at the second bending pipe 31 and influencing the heat exchange efficiency of the heat exchanger.

Specifically, a diameter of the second bending pipe 31 can be greater than a diameter of the first bending pipe 21. On condition that the combined heat exchanger core 10 is used as an evaporator, when a gas-liquid two-phase fluid media flows into the first bending pipe 21, a volume of the fluid media may increase after transferring into a gas phase, so that the fluid media may enter into the second bending pipe 31 from the first collecting pipe 11. At this time, since the diameter of the second bending pipe 31 is greater than the diameter of the first bending pipe 21, the second bending pipe 31 may have enough space for the gas phase fluid media to enter.

Referring to FIG. 1, the combined heat exchanger 100 can further include a connecting member 40. The connecting member 40 can be fixed to sideboards 14 of the two adjacent heat exchanger cores 10. The connecting member 40 can be configured for improving fixing connection and shielding.

In the present disclosure, the connecting member 40 can be a plate-shaped metal member, and can be connected to the sideboard 14 by welding. In some embodiments, the connecting member 40 can be metal members in other shapes, such as a tube-shaped metal member latched to the sideboard 14.

Furthermore, the combined heat exchanger 100 can further include an inlet pipe 50 and an outlet pipe 60. The inlet pipe 50 can be in communication with the first collecting pipe 11, and the outlet pipe 60 can be in communication with the second collecting pipe 12. In this way, the inlet pipe 50 and the outlet pipe 60 can facilitate communication of the fluid media. When the combined heat exchanger 100 is used as the evaporator, the gas-fluid two-phase fluid medium can enter into the first collecting pipe 11 via the inlet pipe 50, transfer into gas phase by evaporating, and flow into the outlet pipe 60 via the second collecting pipe 12.

In some embodiments, the inlet pipe 50 and the outlet pipe 60 can be disposed on a same heat exchanger core 10 of the at least two heat exchanger cores 10. In some embodiments, the inlet pipe 50 and the outlet pipe 60 can be disposed on different heat exchanger cores 10 of the at least two heat exchanger cores 10.

In the present disclosure, since the first communicating member 20 are in communication with the two adjacent first collecting pipes 11 and the second communicating member 30 are in communication with the two adjacent second collecting pipes 12, two adjacent heat exchanger cores 10 are in communication to form a combined heat exchanger 100 without bending the first collecting pipe 11 or the second collecting pipe 12. Conditions such as deformation and surface loss caused by improper bending of the first collecting pipe 11 or the second collecting pipe 12 can be avoided, so that the combined heat exchanger 100 can have improved heat transfer performance and be convenient to assemble or disassemble.

In addition, it should be noted that the terms "first" and "second" are used to qualify the parts only for the purpose of distinguishing the corresponding parts. If not stated otherwise, these words have no special meaning and therefore cannot be construed as limiting the scope of protection of present disclosure.

The technical features of the above-described embodiments may be combined in any combination. For the sake of brevity of description, not all possible combinations of the technical features in the above embodiments are described. However, as long as there is no contradiction between the combinations of these technical features, all should be considered as within the scope of present disclosure.

It should be recognized by the skilled in the art that the above embodiments are intended to illustrate the present disclosure only and are not to be used as a limitation of the present disclosure. Appropriate changes and variations to the above embodiments fall within the scope of protection claimed in present disclosure, provided that they are within the substantial spirit of present disclosure.

We claim:

1. A combined heat exchanger, comprising at least two heat exchanger cores, a liquid separator, a first communicating member and a second communicating member, wherein each of the at least two heat exchanger cores comprises at least a first collecting pipe, a second collecting pipe and a plurality of flat pipes vertically disposed between the first collecting pipe and the second collecting pipe, both ends of the first communicating member are in communication with the first collecting pipes of two adjacent heat exchanger cores, respectively, both ends of the second communicating member are in communication with the second collecting pipes of the two adjacent heat exchanger cores, respectively, and the two adjacent heat exchanger cores are disposed on different planes, wherein the liquid separator is located in the first collecting pipe, and the both ends of the first communicating member are in communication with the liquid separators of two adjacent first collecting pipes, respectively.

2. The combined heat exchanger of claim 1, wherein the first communicating member comprises two first linear pipes and a first bending pipe disposed between the two first linear pipes, and one end of the first linear pipe is in communication with the first collecting pipe and connected to the first collecting pipe by welding.

3. The combined heat exchanger of claim 2, wherein both ends of the first bending pipe are provided with flared sections, respectively, and the two first linear pipes extend into the corresponding flared section, respectively, and are in communication with the first bending pipe.

4. The combined heat exchanger of claim 1, wherein the second communicating member comprises two second linear pipes and a second bending pipe disposed between the two second linear pipes, and one end of the second linear pipe is in communication with the second collecting pipe and connected to the second collecting pipe by welding.

5. The combined heat exchanger of claim 4, wherein a diameter of the second bending pipe is greater than a diameter of the first bending pipe.

6. The combined heat exchanger of claim 1, further comprising a connecting member, wherein the connecting member is fixed to sideboards of the two adjacent heat exchanger cores, and the connecting member is made of metal.

7. The combined heat exchanger of claim 1, further comprising an inlet pipe and an outlet pipe, the inlet pipe is in communication with the first collecting pipe, and the outlet pipe is in communication with the second collecting pipe.

8. The combined heat exchanger of claim 7, wherein the inlet pipe and the outlet pipe are disposed on a same heat exchanger core of the at least two heat exchanger cores, or, the inlet pipe and the outlet pipe are disposed on different heat exchanger cores of the at least two heat exchanger cores.

9. An air conditioning system, comprising the combined heat exchanger of claim 1.

* * * * *